US006843664B2

(12) United States Patent
Belson et al.

(10) Patent No.: US 6,843,664 B2
(45) Date of Patent: Jan. 18, 2005

(54) ELECTRICAL ADAPTER

(75) Inventors: Steve Belson, Plano, TX (US); Christopher C Womack, Dallas, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/053,763

(22) Filed: Jan. 18, 2002

(65) Prior Publication Data

US 2003/0139074 A1 Jul. 24, 2003

(51) Int. Cl.[7] ..... H01R 13/648
(52) U.S. Cl. ..... 439/105; 439/939
(58) Field of Search ..... 439/89, 92, 96, 439/101, 108, 927, 939, 105

(56) References Cited

U.S. PATENT DOCUMENTS 2,067,796 A * 1/1937 Smith ..... 439/108
2,966,651 A * 12/1960 Von Holtz ..... 439/105
2,984,808 A * 5/1961 Bender ..... 439/104
3,382,355 A * 5/1968 Prifogle et al. ..... 362/226
3,440,591 A * 4/1969 Whalen ..... 439/104
3,938,068 A * 2/1976 Hagan ..... 337/189
4,173,383 A * 11/1979 Lee ..... 439/105
4,258,968 A * 3/1981 Holt ..... 439/108
4,296,390 A * 10/1981 Vanderheyden et al. .... 333/182
4,401,355 A * 8/1983 Young ..... 439/607
4,565,417 A * 1/1986 Dussel et al. ..... 439/275
4,579,405 A * 4/1986 Hirooka ..... 439/106
4,926,291 A * 5/1990 Sarraf ..... 361/685
5,735,712 A * 4/1998 Haas et al. ..... 439/609
5,852,544 A * 12/1998 Lee ..... 361/683
6,247,941 B1 * 6/2001 Lee et al. ..... 439/105

* cited by examiner

*Primary Examiner*—Neil Abrams
(74) *Attorney, Agent, or Firm*—Leslie P. Gehman

(57) ABSTRACT

A power connector is configured to float on a computer backplane allowing bulk power supplies to be physically located adjacent to the backplane. This allows use of an EMI gasket between the bulk power supply and the backplane preventing high frequency noise from radiating out of the computer case. Standard electrical plugs may be used on one or both sides of the power connector allowing standard bulk power supplies and line cords to be used on one or both sides of the power connector.

20 Claims, 7 Drawing Sheets

ELECTRICAL ADAPTER

FIELD OF THE INVENTION

This invention relates generally to the field of electrical hardware and more specifically to the field of electrical power connectors for use in electrical hardware.

BACKGROUND OF THE INVENTION

Many electrical devices include an internal bulk power supply (BPS) used to convert alternating current (AC) power supply signals to lower voltage direct current (DC) power supply signals. Often a connector is attached to the chassis of the electrical device allowing a separate power cord to plug into the device. The connector is electrically connected to the bulk power supply within the chassis, often with wires from the connector to the BPS.

This common configuration creates a number of problems. Many electrical components, such as integrated circuits, may be susceptible to electromagnetic interference (EMI) inherent in high frequency components of the AC power supply signals. A variety of methods are commonly used to reduce this interference. AC line filters are used to reduce the high frequency components of the AC power supply signals. Shielding is often used around the power supply to contain high frequency emissions from the bulk power supply within the system. However, shielding adds to cost and makes replacement of the power supply more difficult.

SUMMARY OF THE INVENTION

An AC-to-AC adapter is configured to float on a computer chassis, backplane, or wall of a computer case allowing bulk power supplies to be physically located adjacent to the backplane. This allows use of an EMI gasket between the bulk power supply and the backplane preventing high frequency noise from radiating out of the computer case. Standard electrical plugs may be used on one or both sides of the adapter allowing standard bulk power supplies and line cords to be used on one or both sides of the adapter.

Other aspects and advantages of the present invention will become apparent from the following detailed description, taken in conjunction with the accompanying drawings, illustrating by way of example the principles of the invention.

DETAILED DESCRIPTION

Figure 1:
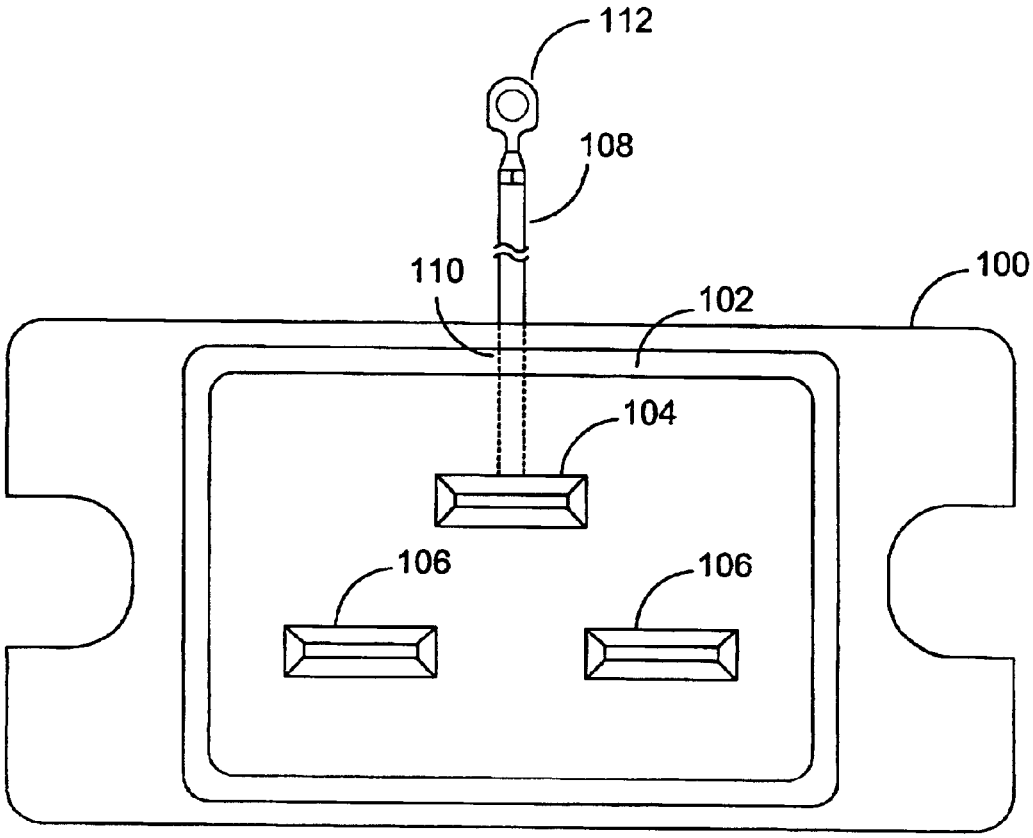
FIG. 1 is a front view of an example embodiment of an AC-to-AC adapter according to the present invention.

FIG. 1 is a front view of an example embodiment of an AC-to-AC adapter 100 according to the present invention.

This example embodiment of the present invention is an AC-to-AC adapter 100 configured to attach to a backplane on an electrical device. The front view of the adapter shows the side of the adapter 100 that resides on the outside of the electrical device. The AC-to-AC adapter 100 shown in FIG. 1 includes an outside AC connector 102 including a ground pin 104 and hot and neutral pins 106. The ground pin 104 is electrically connected to a ground wire 108 through the body of the AC-to-AC adapter 100 with a wire 110 or other electrically conductive material. The ground wire 108 is terminated in a ground connector 112 allowing electrical connection between the ground pin 104 and the backplane of an electrical device. In this example embodiment of the present invention the outside AC connector 102 is a standard IEC 320 (as of Jan. 1, 2002) 20 amp receptacle that accepts a standard IEC 320 (as of Jan. 1, 2002) 20 amp plug. Many other configurations of the outside AC connector 102 may be substituted within the scope of the present invention. Since the adapter 100 includes a ground wire 108 that may be electrically connected to a backplane, the adapter 100 does not need to allow for electrical connection to ground through the means for connecting the adapter 100 to a backplane. The adapter may then move up and down, or side to side with respect to the backplane as needed to allow for misalignments in a bulk power supply as it is attached to the adapter 100 within the electrical device that the adapter 100 is attached to.

Many current computer chassis include a power connector externally similar to that of the present invention. However, in many cases power wires are used to bring power from the connector to an internal bulk power supply. Some computer chassis include metal shielding completely surrounding the bulk power supply, wire, and connector, however, this adds cost to the computer system, and adds to repair time required to change out a failed power supply.

The AC-to-AC adapter 100 of the present invention allows construction of bulk power supplies configured to plug directly into the adapter 100 and to include a built-in AC line filter. The connection between the AC-to-AC adapter 100 and the bulk power supply may then be EMI shielded from the rest of the computer through the use of an EMI gasket between the bulk power supply and the chassis surrounding the connection between the adapter 100 and the bulk power supply. Since the case of the bulk power supply acts as an EMI shield, using an EMI gasket between the bulk power supply and the computer chassis fully encloses all AC power supply lines within an EMI shield.

For safety reasons, the case of the bulk power supply must be electrically connected to the computer chassis and ground. If the case of the power supply is allowed to float while connected to an AC power source, dangerous voltages may develop between the case and ground. Thus, the case of the power supply must be securely electrically connected to ground while power is applied. Many computer systems use a separate wire from the case of the bulk power supply to the computer chassis to ground the power supply case. When replacing bulk power supplies, power to the supply must be shut off before removing this ground wire, thus making hot swapping of the power supply more time consuming and possibly dangerous. The AC-to-AC adapter 100 of the present invention eliminates the necessity of this separate wire since the ground pin/slot is electrically connected to a ground wire 108 that is then electrically connected to the backplane or chassis with a ground connector 112. When the bulk power supply is plugged in to the adapter 100, the ground connection to the backplane or chassis is also accomplished. Thus, safe hot swapping of the bulk power supply may now be possible.

Some computer system designers use EMI shielding gaskets between the case of the bulk power supply and the computer backplane or chassis to act also as a ground connection between the power supply and the chassis. However, when removed from the chassis, EMI shielding may be delicate and prone to damage, thus raising the possibility of poor ground integrity throughout the life of the computer system. The AC-to-AC adapter 100 of the present invention reduces that risk since the ground connection 110 is within the adapter itself and is undisturbed during replacement of the bulk power supply.

Figure 2:
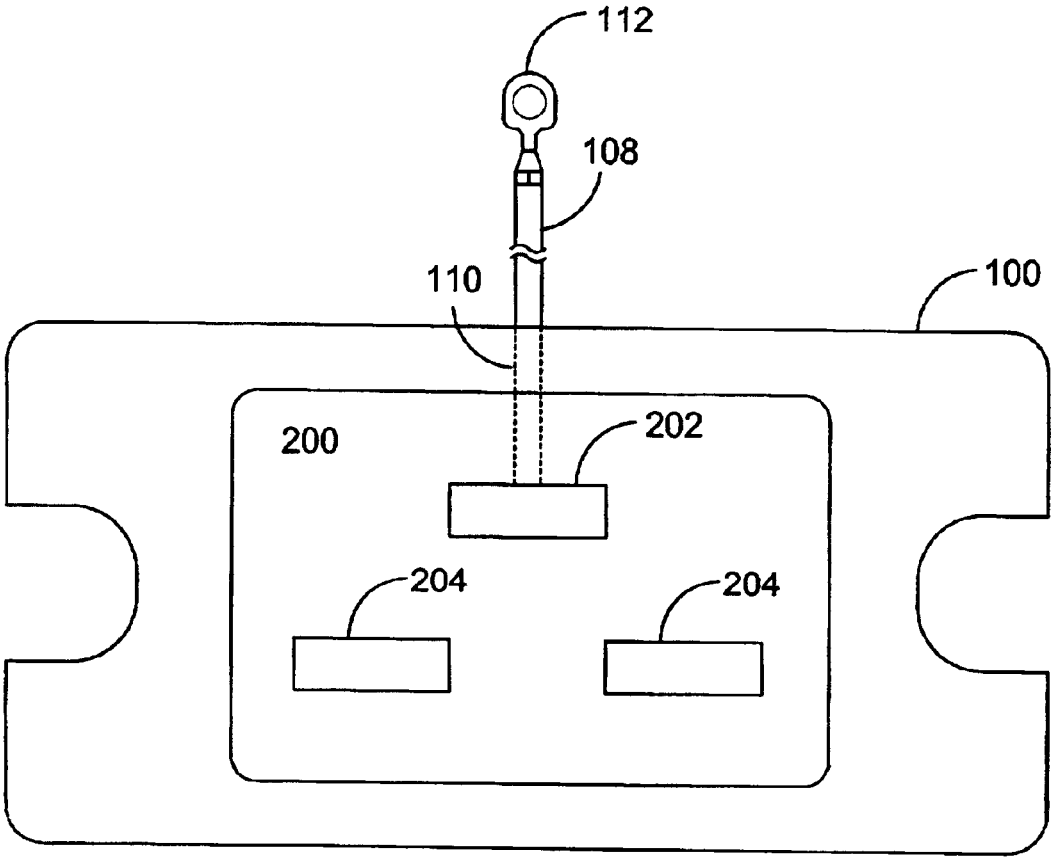
FIG. 2 is a back view of the example embodiment of an AC-to-AC adapter of FIG. 1 according to the present invention.

FIG. 2 is a back view of the example embodiment of an AC-to-AC adapter of FIG. 1 according to the present invention. This example embodiment of the present invention is an AC-to-AC adapter 100 configured to attach to a backplane on an electrical device. The back view of the adapter shows the side of the adapter 100 that resides on the inside of the electrical device. The AC-to-AC adapter 100 shown in FIG. 2 includes an inside AC connector 200 including a ground slot 202 and hot and neutral slots 204. The ground slot 202 is electrically connected to the ground pin 104 shown in FIG. 1. The ground slot 202 is also electrically connected to the ground wire 108 through the body of the AC-to-AC adapter 100 with a wire 110 or other electrically conductive material. The ground wire 108 is terminated in a ground connector 112 allowing electrical connection between the ground slot 202, the ground pin 104 and the backplane of an electrical device. The inside AC connector 200 is configured to connect to a standard bulk power supply. In this example embodiment of the present invention the inside AC connector 200 is a standard IEC 320 (as of Jan. 1, 2002) 20 amp plug that connects with a standard IEC 320 (as of Jan. 1, 2002) 20 amp receptacle. Many other configurations of the inside AC connector 200 may be substituted within the scope of the present invention. This connector 200 may be configured to connect to any desired bulk power supply or any other electrical device within the scope of the present invention. Since the adapter 100 includes a ground wire 108 that may be electrically connected to a backplane or chassis, the adapter 100 does not need to allow for electrical connection to ground through the means for connecting the adapter 100 to a backplane or chassis. The adapter may then move up and down, or side to side with respect to the backplane or chassis as needed to allow for misalignments in a bulk power supply as it is attached to the adapter 100 within the electrical device that the adapter 100 is attached to.

Figure 3:
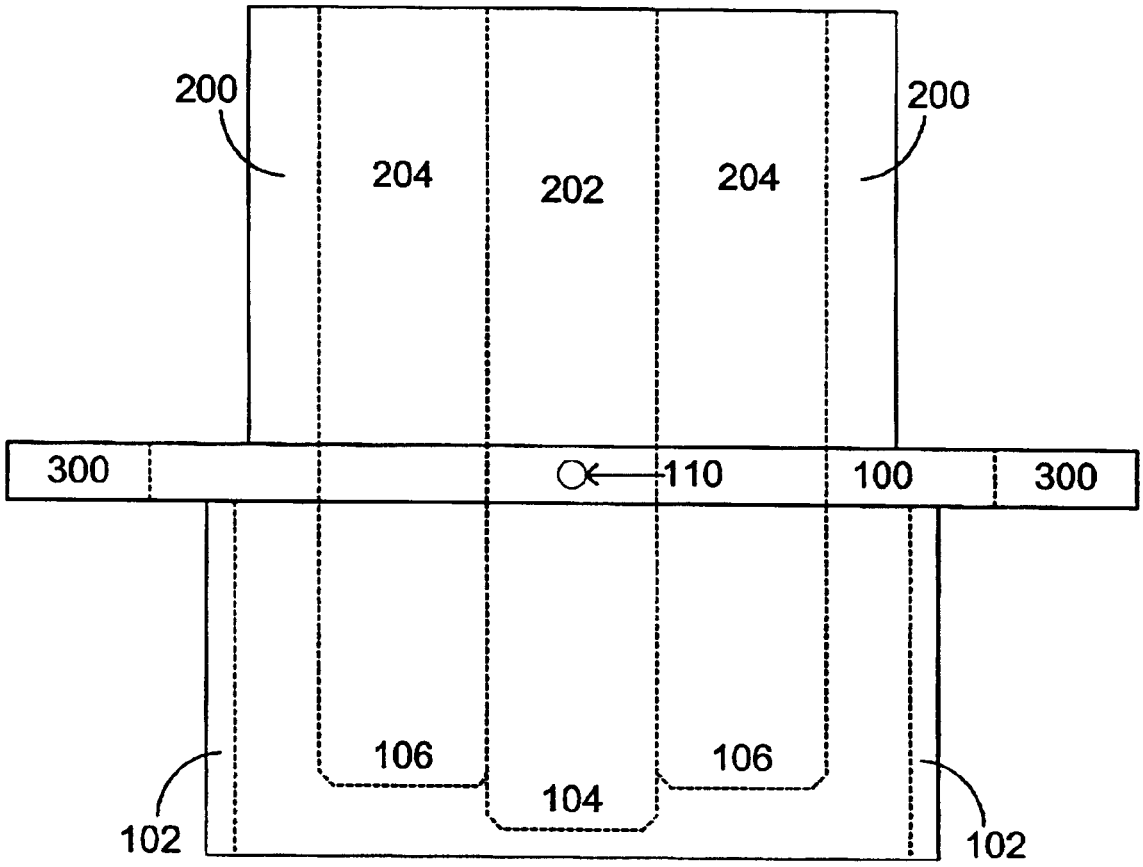
FIG. 3 is a top view of the example embodiment of an AC-to-AC adapter of FIG. 1 according to the present invention.

FIG. 3 is a top view of the example embodiment of an AC-to-AC adapter of FIG. 1 according to the present invention. This example embodiment of the present invention is an AC-to-AC adapter 100 configured to attach to a backplane on an electrical device. The top view of the adapter shows the adapter 100 that is configured to connect to a backplane or chassis allowing movement in two axes. The example embodiment of the present invention includes two cutouts 300 configured to allow attachment to a backplane or chassis with some up and down, and side to side movement, but little in and out movement with respect to the backplane or chassis. Many other attachment means may be used within the scope of the present invention to attach the adapter 100 to a backplane or chassis. This top view shows both the inside AC connector 200 and the outside AC connector 102. The ground wire 108 has been removed for illustration purposes and the wire 110 or other electrical conductor used to connect the ground pin 104 and ground slot 202 is shown on the top of the adapter 100.

Figure 4:
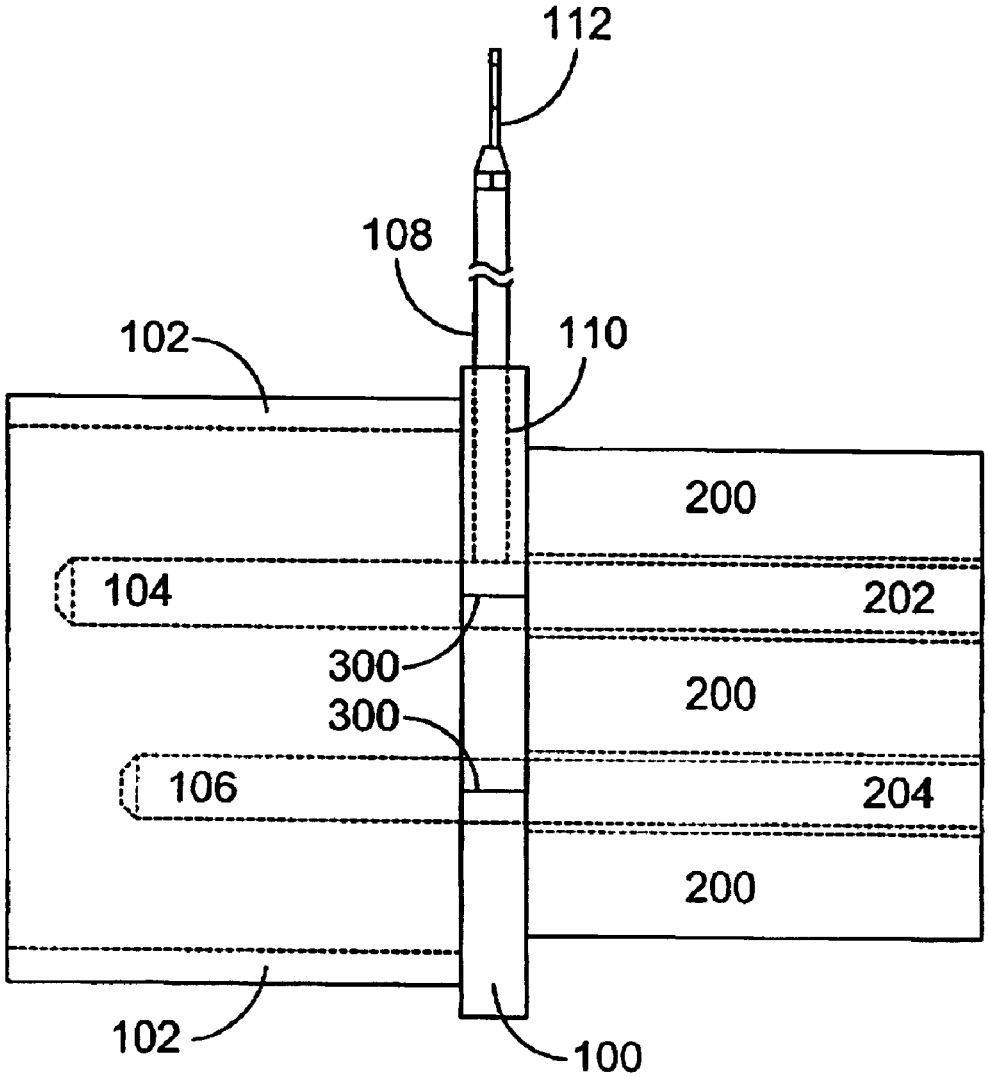
FIG. 4 is a side view of the example embodiment of an AC-to-AC adapter of FIG. 1 according to the present invention.

FIG. 4 is a side view of the example embodiment of an AC-to-AC adapter of FIG. 1 according to the present invention. This example embodiment of the present invention is an AC-to-AC adapter 100 configured to attach to a backplane on an electrical device. The side view of the adapter shows the adapter 100 that is configured to connect to a backplane or chassis allowing movement in two axes. The example embodiment of the present invention includes two cutouts 300 configured to allow attachment to a backplane or chassis with some up and down, and side to side movement, but little in and out movement with respect to the backplane or chassis. Many other attachment means may be used within the scope of the present invention to attach the adapter 100 to a backplane or chassis. This side view shows both the inside AC connector 200 and the outside AC connector 102.

Figure 5:
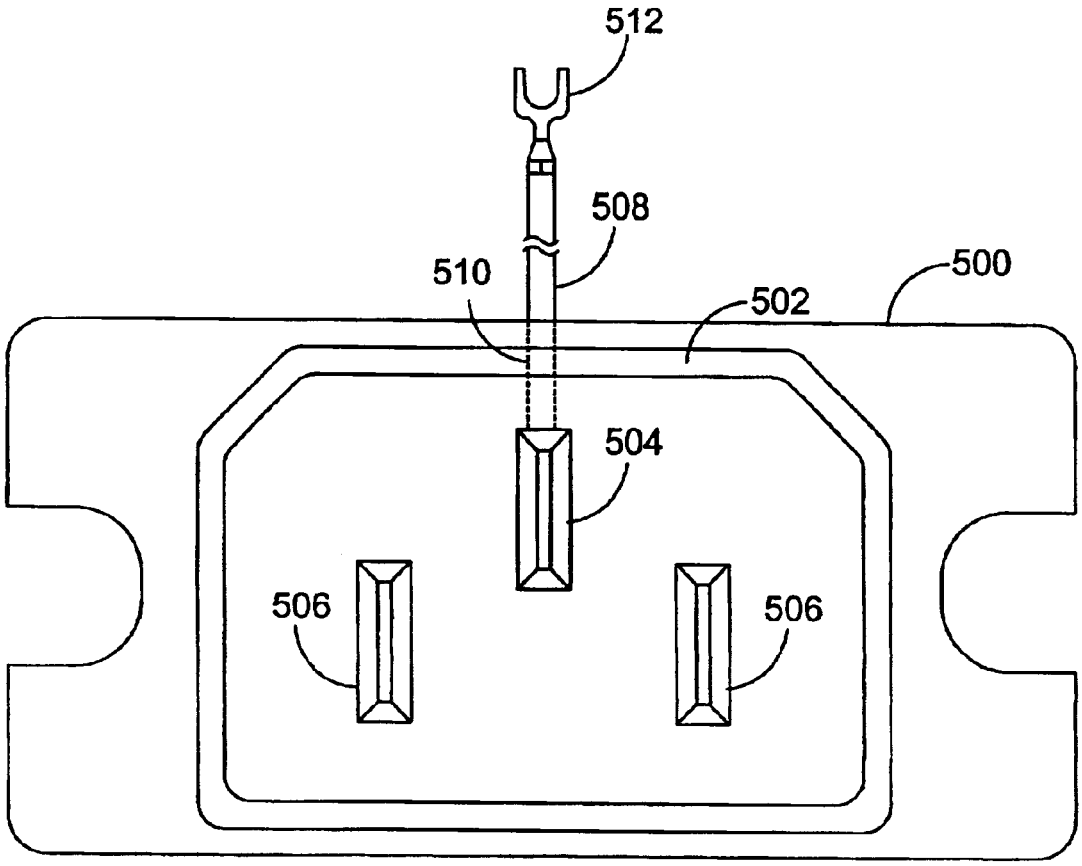
FIG. 5 is a front view of an example embodiment of an AC-to-AC adapter according to the present invention.

FIG. 5 is a front view of an example embodiment of an AC-to-AC adapter according to the present invention. This example embodiment of the present invention is an AC-to-AC adapter 500 configured to attach to a backplane on an electrical device. The front view of the adapter shows the side of the adapter 500 that resides on the outside of the electrical device. The AC-to-AC adapter 500 shown in FIG. 5 includes an outside AC connector 502 including a ground pin 504 and hot and neutral pins 506. This example embodiment of the present invention is similar to the embodiment shown in FIGS. 1 through 4 with the exception of the outside AC connector 502. In this example embodiment a different outside AC connector 502 is used with a different configuration of ground 504 and hot and neutral pins 506. The ground pin 504 is electrically connected to a ground wire 508 through the body of the AC-to-AC adapter 500 with a wire 510 or other electrically conductive material. The ground wire 508 is terminated in a ground connector 512 allowing electrical connection between the ground pin 504 and the backplane of an electrical device. The outside AC connector 502 is configured to connect to a standard electrical power cord. This connector 502 may be configured to connect to any desired electrical power cord within the scope of the present invention. Since the adapter 500 includes a ground wire 508 that may be electrically connected to a backplane, the adapter 500 does not need to allow for electrical connection to ground through the means for connecting the adapter 500 to a backplane. The adapter may then move up and down, or side to side with respect to the backplane as needed to allow for misalignments in a bulk power supply as it is attached to the adapter 500 within the electrical device that the adapter 500 is attached to.

Figure 6:
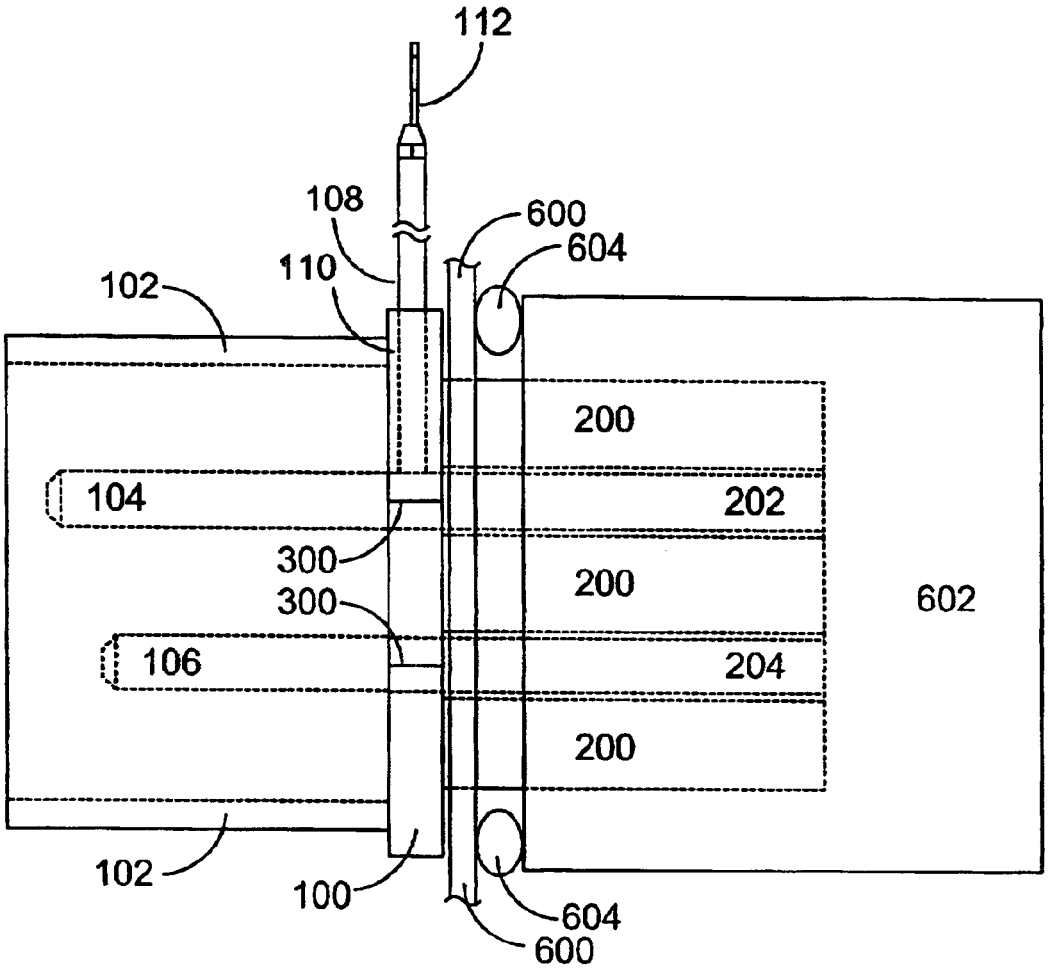
FIG. 6 is a side view of the example embodiment of an AC-to-AC adapter of FIG. 1 according to the present invention attached to a bulk power supply and a chassis.

FIG. 6 is a side view of the example embodiment of an AC-to-AC adapter of FIG. 1 according to the present invention attached to a bulk power supply and a chassis. This view of the AC-to-AC adapter includes the bulk power supply 602 that connects to the adapter 100 along with the chassis 600 that the adapter 100 is attached to in a method allowing movement in two axes. EMI shielding 604 material is shown between the chassis 600 and the power supply 602. This EMI shielding 604 contains the high frequency noise from escaping through the connector system chassis openings, and may be an EMI gasket.

Figure 7:
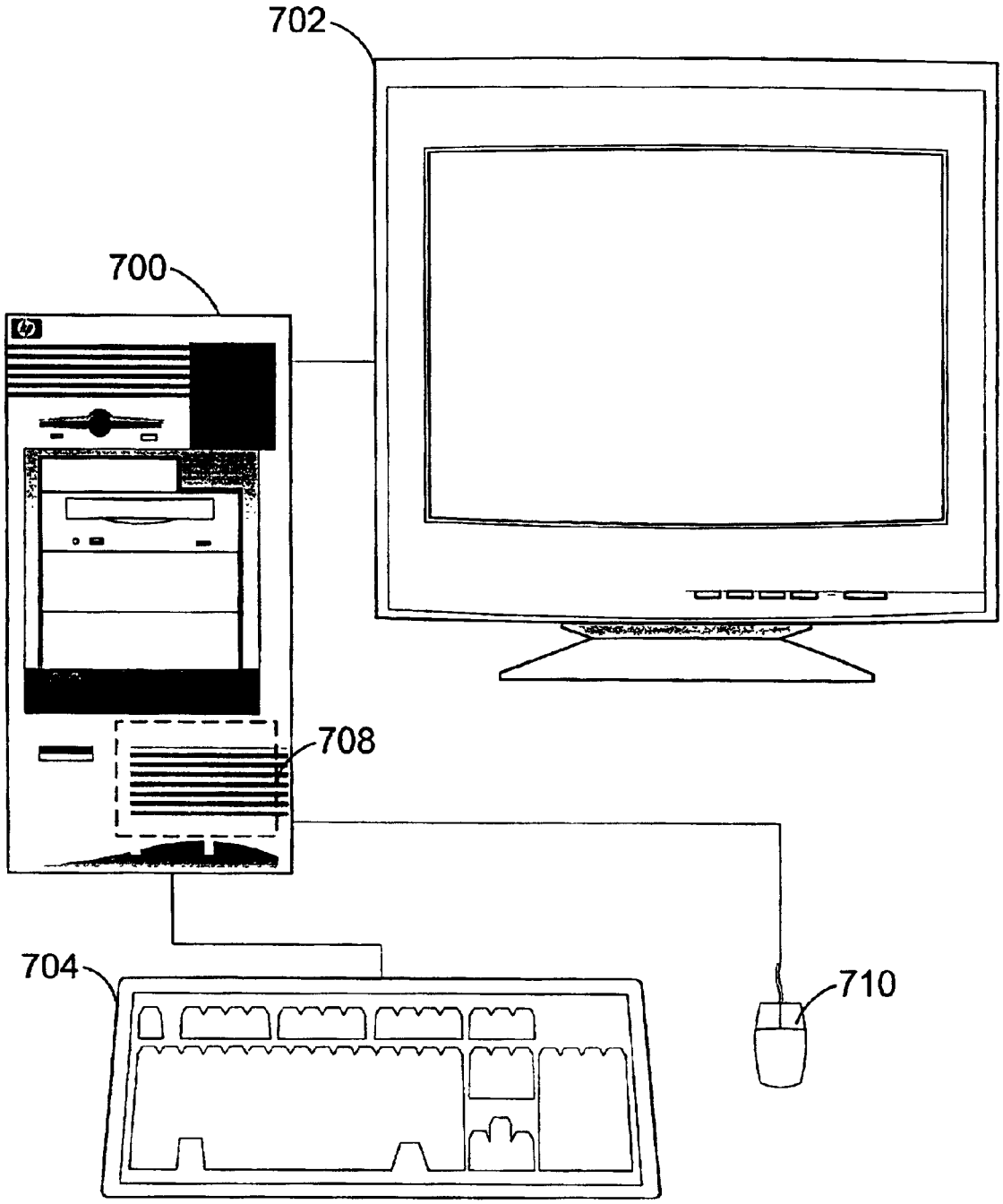
FIG. 7 is an example embodiment of a computer system including an AC-to-AC adapter according to the present invention.

FIG. 7 is an example embodiment of a computer system including an AC-to-AC adapter according to the present invention. The computer system shown in FIG. 7 includes an enclosure 700 surrounding at least part of a chassis 600 including a power supply 708 that is connected to an AC-to-AC adapter 100 that, in turn, is mechanically connected to the chassis 600 in a method allowing movement in two axes, and is electrically connected to the chassis 600 through a ground wire 108 and ground connector 112. The computer system includes a display 702, a keyboard 704, and a mouse 710.

The foregoing description of the present invention has been presented for purposes of illustration and description. It is not intended to be exhaustive or to limit the invention to the precise form disclosed, and other modifications and variations may be possible in light of the above teachings.

The embodiments were chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. An electrical adapter comprising:

an inside AC connector including ground, first, and second pins, configured to electrically connect with an electrical device within said chassis;

an outside AC connector including ground, first, and second slots, wherein said ground slot is electrically connected to said ground pin, said first slot is electrically connected to said first pin, and said second slot is electrically connected to said second pin; and a ground wire electrically connected to said ground pin and said ground slot;

wherein said ground wire is configured to connect to said chassis; also wherein said electrical adapter is configured to mechanically connect to said chassis allowing movement within a plane of said chassis while said electrical adapter is mechanically connected to said chassis, and electrically connected to said electrical device within said chassis.

2. The electrical adapter recited in claim 1, further comprising:

an EMI gasket surrounding said inside AC connector, configured to seal a connection between said inside AC connector and a power supply connected to said inside AC connector.

3. The electrical adapter recited in claim 1:

wherein said first pin is a hot pin;

wherein said first slot is a hot slot;

wherein said second pin is a neutral pin; and wherein said second slot is a neutral slot.

4. The electrical adapter recited in claim 1:

wherein said inside AC connector is an IEC 320 (as of Jan. 1, 2002) 20 amp plug; and wherein said outside AC connector is an IEC 320 (as of Jan. 1, 2002) 20 amp receptacle.

5. An electrical adapter comprising:

an inside AC connector including ground, first, and second slots, configured to electrically connect with an electrical device within said chassis;

an outside AC connector including ground, first, and second pins, wherein said ground pin is electrically connected to said ground slot, said first pin is electrically connected to said first slot, and said second pin is electrically connected to said second slot; and a ground wire electrically connected to said ground pin and said ground slot;

wherein said ground wire is configured to connect to said chassis; also wherein said electrical adapter is configured to mechanically connect to said chassis allowing movement within a plane of said chassis while said electrical adapter is mechanically connected to said chassis, and electrically connected to said electrical device within said chassis.

6. The electrical adapter recited in claim 5, further comprising:

an EMI gasket surrounding said inside AC connector, configured to seal a connection between said inside AC connector and a power supply connected to said inside AC connector.

7. The electrical adapter recited in claim 5:

wherein said first slot is a hot pin;

wherein said first slot is a hot slot;

wherein said first slot is a hot slot;

wherein said second pin is a neutral pin; and wherein said second slot is a neutral slot.

8. The electrical adapter recited in claim 5:

wherein said inside AC connector is an IEC 320 (as of Jan. 1, 2002) 20 amp receptacle; and wherein said outside AC connector is an IEC 320 (as of Jan. 1, 2002) 20 amp plug.

9. An enclosure comprising:

a chassis configured to hold at least one power supply; and an electrical connector attached to said chassis allowing movement within a plane of said chassis, including:

an inside AC connector including ground, hot, and neutral pins, configured to electrically connect to at least one of said power supplies;

an outside AC connector including ground, hot, and neutral slots, wherein said ground slot is electrically connected to said ground pin, said hot slot is electrically connected to said hot pin, and said neutral slot is electrically connected to said neutral pin; and a ground wire electrically connected to said ground pin, said ground slot, and said chassis; and a power supply contained within said enclosure and electrically connected to said inside AC connector.

10. The enclosure recited in claim 9, further comprising:

an EMI gasket surrounding said inside AC connector, configured to seal a connection between said inside AC connector and said power supply.

11. The enclosure recited in claim 9:

wherein said inside AC connector is an IEC 320 20 amp plug; and wherein said outside AC connector is an IEC 320 20 amp receptacle.

12. An enclosure comprising:

a chassis configured to hold at least one power supply;

an electrical connector attached to said chassis allowing movement within a plane of said chassis, including:

an inside AC connector including ground, hot, and neutral slots, configured to electrically connect to at least one of said power supplies;

an outside AC connector including ground, hot, and neutral pins, wherein said ground pin is electrically connected to said ground slot, said hot pin is electrically connected to said hot slot, and said neutral pin is electrically connected to said neutral slot; and a ground wire electrically connected to said ground pin, said ground slot, and said chassis; and a power supply contained within said enclosure and electrically connected to said inside AC connector.

13. The enclosure recited in claim 12, further comprising:

an EMI gasket surrounding said inside AC connector, configured to seal a connection between said inside AC connector and said power supply.

14. The enclosure recited in claim 12:

wherein said inside AC connector is an IEC 320 (as of Jan. 1, 2002) 20 amp receptacle; and wherein said outside AC connector is an IEC 320 (as of Jan. 1, 2002) 20 amp plug.

15. A device comprising:

an chassis configured to hold at least one power supply; and an electrical connector attached to said chassis allowing movement within a plane of said chassis, including:

an inside AC connector including ground, hot, and neutral pins, configured to electrically connect to at least one of said power supplies;

an outside AC connector including ground, hot, and neutral slots, wherein said ground slot is electrically connected to said ground pin, said hot slot is electrically connected to said hot pin, and said neutral slot is electrically connected to said neutral pin; and a ground wire electrically connected to said ground pin, said ground slot, and said chassis; and a power supply contained within said chassis and electrically connected to said inside AC connector.

16. The device recited in claim 15, further comprising:

an EMI gasket surrounding said inside AC connector, configured to seal a connection between said inside AC connector and said power supply.

17. The device recited in claim 15:

wherein said inside AC connector is an IEC 320 (as of Jan. 1, 2002) 20 amp plug; and wherein said outside AC connector is an IEC 320 (as of Jan. 1, 2002) 20 amp receptacle.

18. A device comprising:

an chassis configured to hold at least one power supply; and an electrical connector attached to said chassis allowing movement within a plane of said chassis, including:

an inside AC connector including ground, hot, and neutral slots, configured to electrically connect to at least one of said power supplies;

an outside AC connector including ground, hot, arid neutral pins, wherein said ground pin is electrically connected to said ground slot, said hot pin is electrically connected to said hot slot, and said neutral pin is electrically connected to said neutral slot; and a ground wire electrically connected to said ground pin, said ground slot, and said chassis; and a power supply contained within said chassis and electrically connected to said inside AC connector.

19. The device recited in claim 18, further comprising:

an EMI gasket surrounding said inside AC connector, configured to seal a connection between said inside AC connector and said power supply.

20. The device recited in claim 18:

wherein said inside AC connector is an IEC 320 (as of Jan. 1, 2002) 20 amp receptacle; and wherein said outside AC connector is an IEC 320 (as of Jan. 1, 2002) 20 amp plug.

* * * * *

UNITED STATES PATENT AND TRADEMARK OFFICE

CERTIFICATE OF CORRECTION

PATENT NO. : 6,843,664 B2
APPLICATION NO. : 10/053763
DATED : January 18, 2005
INVENTOR(S) : Steve Belson et al.

It is certified that error appears in the above-identified patent and that said Letters Patent is hereby corrected as shown below:

IN THE CLAIMS

Claim 7, Column 6, line 4, after "first" delete "slot" and insert therefor --pin--

Claim 7, Column 6, line 6, delete "wherein said first slot is a hot slot;"

Claim 18, Column 8, line 9, after "hot," delete "arid" and insert therefor --and--

Signed and Sealed this

Twenty-seventh Day of May, 2008

JON W. DUDAS
*Director of the United States Patent and Trademark Office*